United States Patent [19]

Teodorescu et al.

[11] 4,066,049

[45] Jan. 3, 1978

[54] INTERNAL COMBUSTION ENGINE HAVING A VARIABLE ENGINE DISPLACEMENT

[75] Inventors: Gheorghe Marcel Teodorescu, Bucharest; Aurel Popa, Breaza, both of Romania

[73] Assignee: Institutul National Pentru Creatie Stintifica si Tehnica - Increst, Bucharest, Romania

[21] Appl. No.: 609,095

[22] Filed: Aug. 29, 1975

[30] Foreign Application Priority Data

Sept. 2, 1974 Romania ..... 79892

[51] Int. Cl.[2] ..... F02B 75/04

[52] U.S. Cl. ..... 123/48 R; 123/48 B; 123/75 BA

[58] Field of Search ..... 123/48 R, 48 B, 78 BA, 123/58 R, 58 B, 58 A

[56] References Cited

U.S. PATENT DOCUMENTS 1,968,470 7/1934 Szombathy ..... 123/48 B

*Primary Examiner*—Ronald H. Lazarus
*Attorney, Agent, or Firm*—Karl F. Ross

[57] ABSTRACT

The present invention refers to a four-cycle, internal combustion engine whose pistons have variable strokes, the adjustment of the piston displacement and of the fuel consumption being automatically and continuously realized as a function of the drive shaft load torque.

The engine uses an axially annular equidistant location of the cylinders in a cylinder block, comprising an odd number of pistons whose connecting rods are connected, by means of ball joints, with a central oscillating ball, diametrically penetrated by a drive shaft, the ball being sustained by two journal bearings mounted in a gliding bracket. The drive shaft is provided at one of its ends with two oppositely mounted sides that can move along two grooves formed in the inner surfaces of a fork provided at the end of an output shaft, another drive shaft end being coupled directly to a planetary reduction gear box for the control of the intake and exhaust valves.

The position of the two slides within the guiding grooves and the groove angle determine the central ball amplitude of oscillation, the piston stroke and, implicitly, the piston displacement and the engine compression ratio.

8 Claims, 5 Drawing Figures

Fig. 2
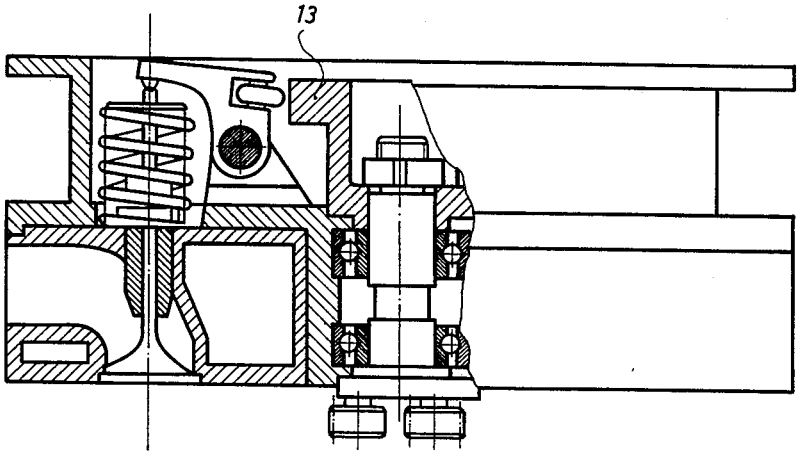
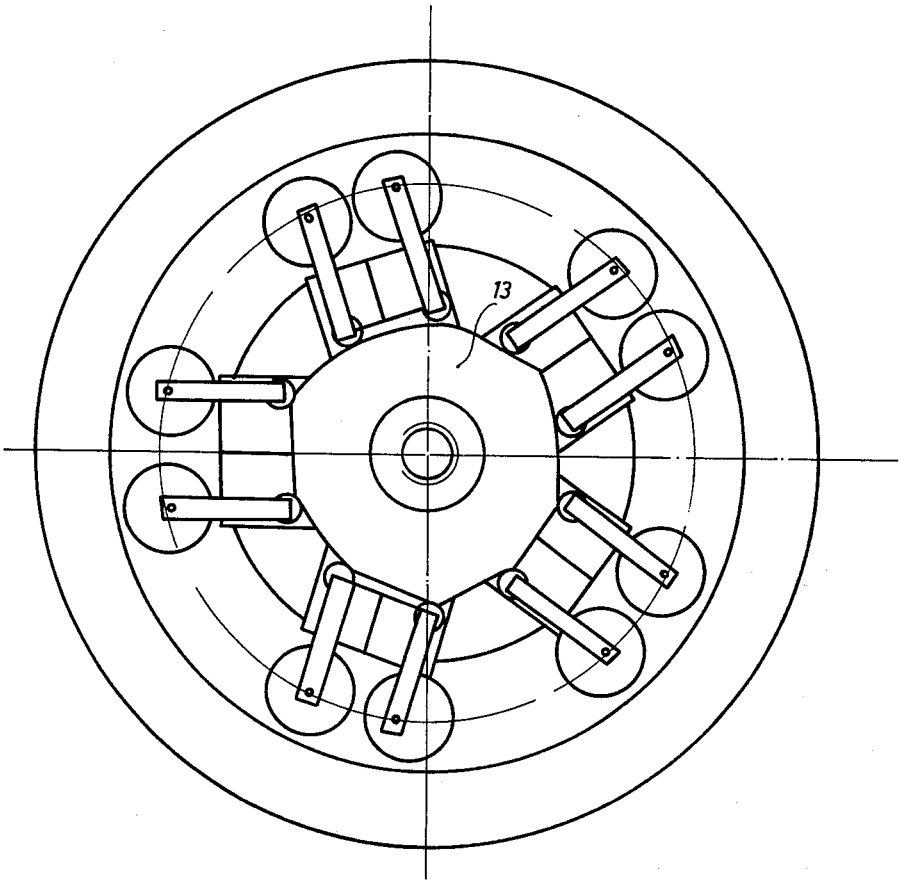
Fig. 3

INTERNAL COMBUSTION ENGINE HAVING A VARIABLE ENGINE DISPLACEMENT

FIELD OF THE INVENTION

The present invention refers to a four - cycle, internal combustion engine whose pistons have variable strokes, the adjustment of the piston displacement and of the fuel consumption being automatically and continuously realized as a function of the drive shaft load torque.

BACKGROUND OF THE INVENTION

The clasic internal combustion engine operates with constructive uniform piston strokes, thus determining a single value for the torque at maximum output, this being calculated so as to surpass the highest stress to be encountered by the engine, representing a disadvantage because the load torque variation encountered by the engine of a vehicle in operation, does not correspond in an economically proportional variation of the fuel consumption.

Another disadvantage of the above mentioned engine is represented by the existence of the crankshaft as a machine element in the mechanism that converts linear motion into rotary motion, creating for the piston some radial component forces in the rotation plane of the crankshaft, these radial forces causing the pistons and cylinders to wear and also decrease the mechanical efficiency.

At the same time, another shortcoming of the classic internal combustion engine is represented by the relatively long linkage between the cam shaft and the intake and exhaust valves.

The lack of an elastic element within the linkage of the mechanism converting linear motion into rotary motion constitutes another disadvantage of the classic engine; that elastic element would damp the shocks produced by the explosions of the fuel mixture within the combustion chamber, thus provides a an improvement in the endurance limit of the machine elements as well as, esspecially with Diesel and other fast engines, diminish the rocking along the piston working axis.

Another internal combustion engine is known, having variable piston displacement, in which the variation of the piston displacement is obtained both by changing the length of the piston stroke - using a change in the actual length of the crank driven by the piston - and by correspondingly changing the distance between the cylinder head and the crankshaft, getting the desired compression ratio.

The variation of the actual length of each crank is obtained by means of an eccentric bushing interposed between the crankshaft and the connecting rod, with the large end thereof encasing it, and by means of a mechanism adjusting the bushing position as to the crank.

Each cylinder head of that engine can move axially inside its cylinder and is coupled to a control mechanism contiguous with a mechanism which modifies the stroke length - so that the distance between the cylinder head and the crankshaft varies with the stroke, the adjustment of the mechanism being mannually or automatically done.

As far as the valves are concerned, the rocker arms are mounted on the mobile head of each cylinder in order to monitor the opening of the valves, they being mounted swivelably on eccentrics interlocked with a shaft mounted on a fixed body and connected to a mechanism which moves the cylinder head nearer to or further from the crankshaft so that the virtual oscillating axis of the rocker arms can be displaced according to the cylinder head.

The above mentioned engine having variable piston displacement has the disadvantage of a very complicated construction, increasing the possibility for insignificant wear in the linkage adjusting the stroke, causing major misadjustments of the engine operation. The mobile cylinder head presents special machining and operation problems (that is, sealing and cooling problems). At the same time, the mechanical efficiency of that engine is very low.

SUMMARY OF THE INVENTION

The internal combustion engine, according to the invention, avoids the above mentioned disadvantages by using an axially annular equidistant array of an odd number of pistons inside a cylinder block, the connecting rods of the pistons being connected, by means of joints, with a central oscillating ball whose motion is nutational, diametrically penetrated by a drive shaft, the central ball being sustained by two journal bearings mounted in a bracket which can move axially and translationally within a crankcase, the adjustment of the bracket position being done through the instrumentality of a mechanical or hydraulic system. At one of its ends, the drive shaft is provided with two oppositely mounted sides which can move along two grooves cut in the inner surfaces of the fork arms of an output shaft so that the position of the slides in the grooves, together with the groove angle, determine the central ball amplitude of oscillation, (nutation), the stroke and, implicitly, the piston displacement and the engine compression ratio, the other end part of the drive shaft entraining another output shaft which drives a cam for controlling the valves. The equilibrium of the inertia torque is maintained by with two counter-weights oppositely mounted and normally located on the drive shaft axis acting as a flywheel.

BRIEF DESCRIPTION OF THE DRAWING

The above and other objects, features, and advantages of the present invention will become more readily apparent from the following description, reference being made to the accompanying drawing in which:

FIG. 2 is a cross-section through the cylinder head and through the valve cam;

FIG. 3 is a front view of the valve cam;

SPECIFIC DESCRIPTION

Figure 1:
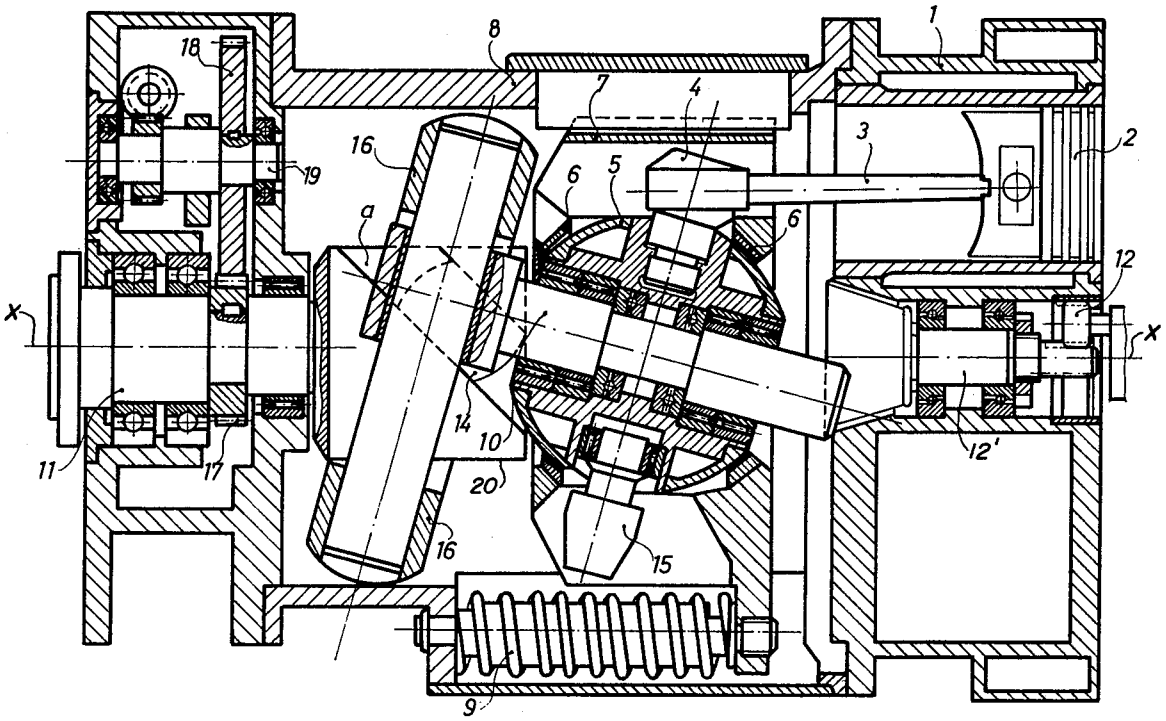
FIG. 1 is a longitudinal section through the cylinder block and the crankcase.

The internal combustion engine having varying engine displacement, according to the present invention, uses a cylindrical or taper cylinder block 1, in which there are an odd number of pistons 2, whose connecting rods 3 are attached by means of ball joints 4 to a central ball 5 to which an oscillating (nutational) motion is imparted. The central ball 5 is supported by two journal bearings 6 mounted on a bracket 7 which can move axially and translationally within a crankcase 8 due to the gas pressure on the pistons 2 in a downstroke sense, or due to coil springs 9 in an upstroke sense. The drive shaft 10 penetrates the central ball 5 diametrically and imparts the rotary motion both to the output shaft 11 and to a second output shaft 12' driving the planetary reduction gear 12 entraining the cam disk 13. The drive shaft 10 is provided at its back end with two oppositely mounted slides 14 which can slide in two grooves a cut in the inner surfaces of the fork arms 20 of the output shaft 11 determining the variation of the ball amplitude of oscillation and, implicitly, the piston stroke variation. A counterweight 15, mounted within the body of the central ball 5, annuls the load momentum of the engine torque, as do counter weights 16, mounted on the drive shaft 10. A gear 17 is mounted on the output shaft 11, transmiting the rotary motion to a gear 18 mounted on a driven shaft 19 which entrains the well-known engine accessories: fuel pump, ignition unit, alternator etc.

The internal combustion engine, according to the present invention, operates as follows:

Moving alternately, the engine pistons 2 move in a reciprocating motion and, by means of the connecting rods 3 and the ball joints 4, drive the central ball 5 in a nutating movement — so that the axis of the drive shaft 10 generates two opponent cones with their vertices in the center of the central ball 5, shaping the angle *g* between the cone generatrices *dd* (axis of the drive shaft 10) and the straight line *xx* (axis of the output shaft 11).

With the piston at the inner dead centre, the same angle *g* can be found between the axis *bb*, passing through the centre of the ball joint 4 and through the centre of the central ball 5, and the line *yy*, normal on the line *xx*, and passing through the center of the central ball 5.

Figure 4:
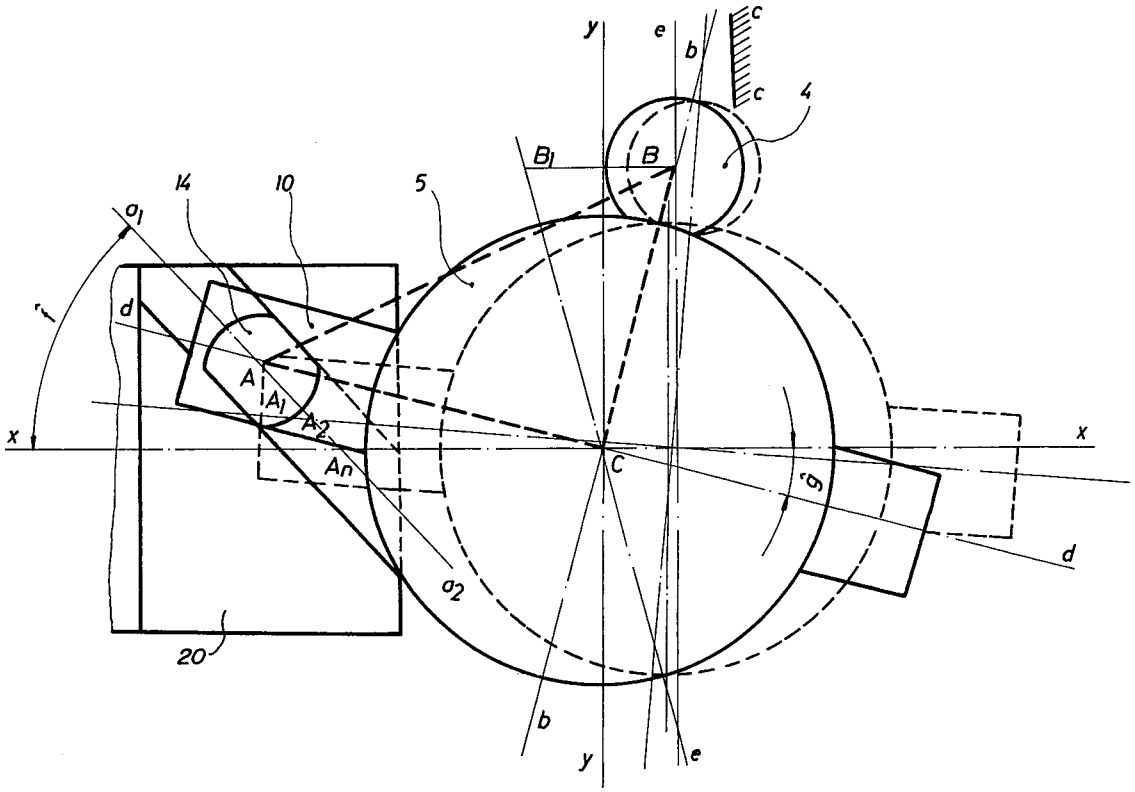
FIG. 4 is a diagram of the mechanism for converting the linear motion into rotary motion.

The stroke length $BB_1$ of the piston 2 equals the crankpin arm (2BC. sine *g*) — see FIG. 4.

The back end of the drive shaft 10 engages the output shaft 11 by the fork 20, the position of the drive shaft in the drive in the fork being determined by the two slides 14 that can glide along the groove *a*, forming an angle *f* with the straight line *xx*.

Figure 5:
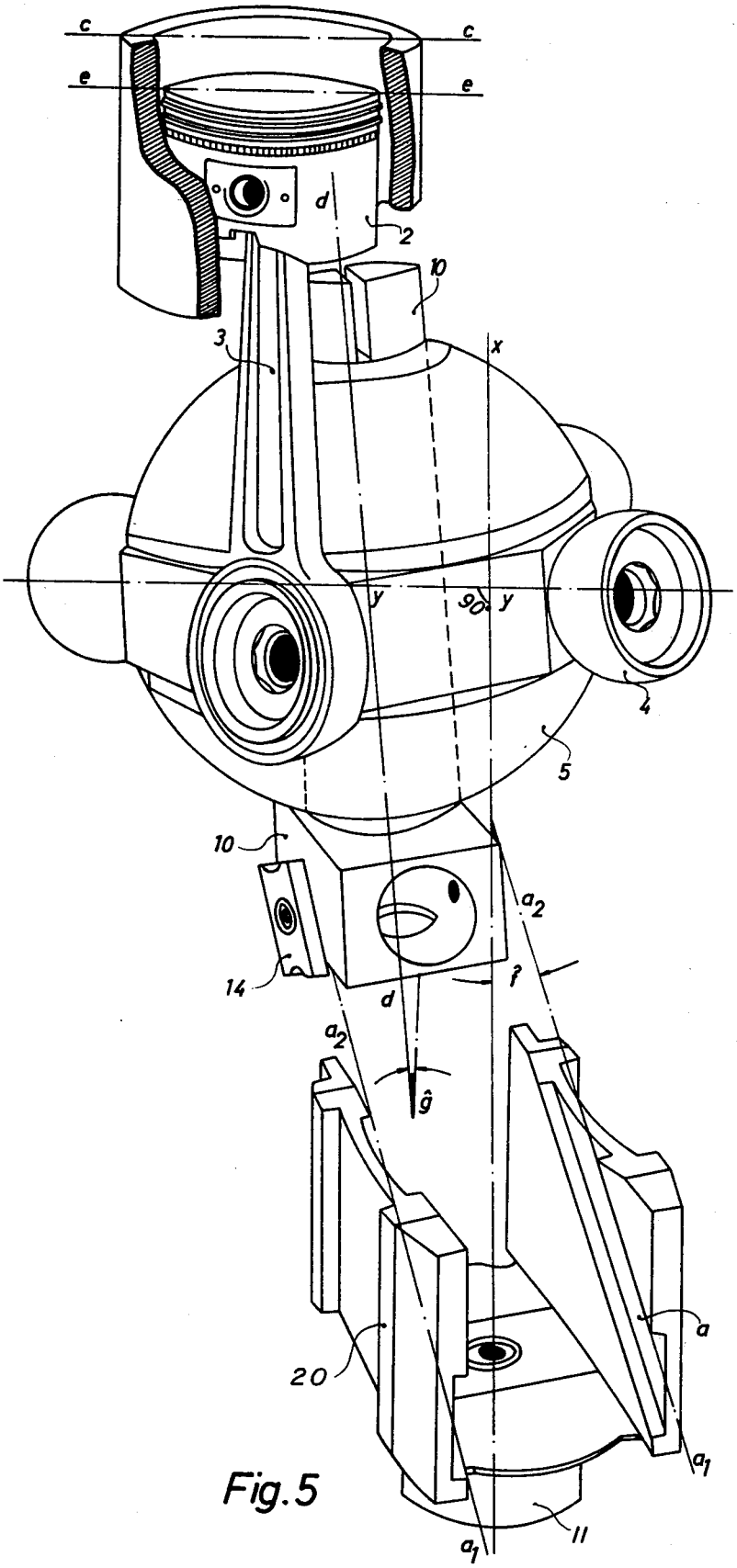
FIG. 5 is a perspective view of the diagram in FIG. 4.

The bracket 7 can glide, together with the central ball 5, along the axis of the output shaft 11 (straight line *xx*) — see FIG. 5, the position of the central ball 5 at a given moment being determined by the equilibrium established between the two opposite forces acting on the bracket 7 in the same axial direction: the first, the resultant of the forces acting on the pistons 2 as a consequence of the gas pressure, which moves the central ball 5 away from the cylinder block 1, and the second one, generated by a hydraulic or mechanical system 9, manually or automatically controled, resulting in a biasing of the central ball 5 in an equilbrium position.

The axial displacement of the central ball 5 determines a displacement of the slides 14 along the inclined groove *a* whose axis $a_1a_2$ shapes an angle *f* with the axis *xx* of the output shaft 11. The value of the angle *f*, together with the axial displacement of the bracket 7, determines the variation of the angle *g* and, implicitly, the stroke variation of the pistons 2.

The stroke value of the pistons 2, corresponding to the stress at a given moment, keeps constant as long as the engine is operating under conditions of constant duty, a change in the operating conditions determining a new equilibrium position, a new axial displacement of the central ball 5 and thus, a new stroke value of the pistons 2.

This way, by varying the stroke of the pistons 2 and, implicitly, the piston displacement, the engine will always develop the minimal output necessary to surpass the load torque at the output shaft 11, getting, under any circumstances, economical operating conditions.

The output shaft 11 entrains, by means of the gear 17 and of the intermediary gear 18, the driven shaft 19 which draw the accessories of the engine.

The front end of the drive shaft 10 entrains the planetary reduction gear 12 which, in its turn, actuates the cam disk 13 (see FIGS. 1, 2 and 3).

a slot formed in the bracket 7 (see FIG. 1). For the same purpose, it is possible to guide the connecting rod small end through a corresponding slot effected in the same bracket 7.

The damping of the inertia forces torque is done with an equal but oponent torque generated by two counterweights 16, rotating in a normal plane on the axis of the drive shaft 10, their rotational speed being equal to that of the drive shaft 10, at an angle varying with the axis *yy* and always equal to the angle *g*.

The engine, according to the present invention, can be operated in the following functioning versions, corresponding to the values of the angle *f*, shaped by the axis $a_1a_2$ of the groove *a* and by the axis *xx* of the exit shaft 11.

VERSION ONE

If the center of the wedges 14 generates a curve $A_1 \ldots A_n$, shaping an angle *f* between the axis $a_1a_2$ of the groove *a* and the axis *xx* of the output shaft 11, so that the ratio $V+v/v$ to be kept constant, where *v* represents the volume displaced by the piston movement from ODC ($B_1$) to IDC (B), and *v* represents the combustion chamber volume, respectively, according to FIG. 4, the volume between the cylinder and the two normal planes on the cylinder axis — that is the planes including the straight lines *cc* and *ee*, we shall get the version: VARYING STROKE AT A CONSTANT COMPRESSION RATIO. In this particular case, the angle *f* gets the value $f_o$.

VERSION TWO

For *f* greater than $f_o$, one gets an increasing compression ratio for an increasing piston stroke.

VERSION THREE

For *f* smaller than $f_o$, one gets a decreasing compression ratio for an increasing piston stroke.

VERSION FOUR

In case *f* equals zero, a varying compression ratio for a constant piston stroke is obtained.

The internal combustion engine having a varying engine displacement, according to the invention, has the following advantages:

- it reduces the fuel consumption;
- it has a better mechanical efficiency;
- it has a simple and solid construction, technologically easy to execute (eliminating the crankshaft, using the cam disk and a piston of reduced height etc.)
- its shape is adapting to existing vehicles;
- it exposes a reduced and uniform wear of the piston - cylinder assembly due to the elimination of the radial component of the force resulting from the crankshaft; and
- it has a reduced cost price.

DETAILED DESCRIPTION OF THE OPERATIONAL SEQUENCE

Assuming a constant load on the first output shaft 11. As the spark plugs in the respective cylinders fire in turn, each of the pistons 2 is driven to the left (FIG. 1) to produce a nutational movement of the ball 5 about the axis defined by the intersection of the equatorial plane at which the ball joints 4 and counterweights 15 are located and the axis of the drive shaft 10. The drive shaft 10 sweeps around the axis *x* of the output shaft 11 which it entrains via the slides 14 in the respective inclined grooves *a* of the fork 20. Thus the axis of the drive shaft 10 describes a cone about the axis *x* and rotates the output shaft 11 which is connected to the load at constant torque. The gears 17, 18 operate the auxiliary shaft to permit the fuel pump, ignition unit, alternator and the like to operate.

The other end of the drive shaft 10 also describes a conical movement with the same apex angle to entrain the shaft 12' and thereby drive the reduction gear 12. The latter rotates (FIG. 2) the cam 13 which operates the valves of the engine. As is well known, the intake valve opens during the intake stroke, is closed during the compression stroke, is closed during the exhaust stroke and is closed during the firing stroke. Correspondingly, the exhaust valve opens during the exhaust stroke and is otherwise closed.

If the load on shaft 11 increases, the slide 14 moves to the left in guide *a* (FIG. 1) and thereby pulls the shaft 10 to the left to shift the center of the ball 5 along the axis *x* and automatically increases the volume of the cylinder, i.e. the total cubic cemtimeter volume of the cylinders. At the same time, the slide has moved upwardly (FIG. 1) because the groove *a* is not parallel to the axis of shaft 10. This results in a pivotal displacement of the shaft 10 about the aforementioned center of ball 5, i.e. in a tilt of the equatorial plane from its original position in a clockwise sense as shown in FIG. 1 and a simultaneous increase in the apex angle of the cone described by the axis of shaft 10 as it sweeps around the axis *x*. This tilt of the equatorial axis shifts the right-hand dead center position of each piston 2 closer to the cylinder head and each left-hand dead center position of the piston 2 further away from the cylinder head than was earlier the case. This corresponds to an increase in the cubic centimeter displacement of the pistons. Hence, for increasing torque or load both the total cylinder volume and the displacement of the engine are varied.

On the other hand, should the load decrease, the slide 14 automatically shifts downwardly and to the right (FIG. 1) and swings the axis of shaft 10 more closely into parallelism with axis *x*, i.e. reduces the apex angle of the cone described by the axis of shaft 10. Since shaft 10 is axially fixed in the ball, the ball 5 and its housing 6 move axially to the right so that the main position of the end of the piston 2 is closer to the cylinder head. Simultaneously, the tilting of shaft 10 corresponds to a swing of the equatorial plane of the ball so that the latter more closely approaches *a* perpendicular to axis *x*, causing the right-hand dead center position of piston 2 to recede from the cylinder head and the left-hand center dead position to more closely approach the cylinder head. The piston stroke and hence the displcement is correspondingly reduced. The movement of the slide 14 along the groove *a* is brought about by the springs 9 which urge the housing 6 to the right and the relative drag of the shaft 11 with respect to the ball 5 as the latter is driven about the axis *x*. This if the shaft 11 lags the ball 5, the slide 14 will ride up in the groove *a* (i.e. upwardly and to the left), compressing the springs 9 and causing the center of ball 5 to move to the left. With less loading of the shaft, the drag thereof is reduced and under the action of the springs 9, the ball 5 is urged to the right as seen in FIG. 1.

There is, therefore, always a dynamic equilibrium between the load of the shaft 11 (torque) the position of the center of the ball 5 along the axis *x* which automatically adjusts both the piston stroke and the total effective cylinder volume to the load.

We claim:

1. An internal-combustion engine having a variable engine displacement comprising:

a housing having a generally centrally located axis;

an odd number of cylinders formed at a first end of said housing parallel to said axis and arranged in a circular array centered on said axis, said cylinders being equally spaced in said circular array and each of said cylinders being provided with a piston;

a movable ball in said housing centered on said axis and articulated to said pistons along an equator of said ball for producing a nutational movement thereof;

a drive shaft journaled in said ball having a shaft axis passing through the center thereof and perpendicular to the plane of said equator;

a first output shaft journaled at a second end of said housing along said axis of said housing;

slide means on said first output shaft engaging one end of said drive shaft for translating the nutational motion thereof to rotary motion, said plane being tiltable variably in response to the torque on said first output shaft;

a support on said housing mounted outwardly of said ball and shiftable toward and away from said cylinders journalling said ball and provided with means for biasing said ball along the axis of said housing and positioning said ball in an equilibrium position responsive to the load on said first output shaft.

2. An internal-combustion engine having a variable engine displacement as defined in claim 1, further comprising:

a second output shaft journaled at said first end of said housing along said axis thereof;

means on said second output shaft engaging the other end of said drive shaft for translating the nutational motion thereof to rotary motion; and a single cam geared to said second output shaft for operating of the engine intake and exhaust valves.

3. An internal-combustion engine having variable engine displacement as defined in claim 1, further comprising:

a driven shaft journaled at said second end of said housing parallel to said axis;

a geared portion on said first output shaft;

a first gear on said driven shaft entrained by said geared portion for rotating said driven shaft; and a second gear on said driven shaft entraining means for operating accessory equipment necessary for the operation of said engine.

4. An internal-combustion engine having variable engine displacement as defined in claim 1 wherein said slide means for translating nutational motion to rotary motion comprises:

a pair of slides pivotally mounted on the diametrically opposite sides of a portion of said shaft extending beyond said ball in the direction of said first output shaft;

a fork formed at the end of said first output shaft having arms extending along either side of said drive shaft opposite said slides; and parallel grooves formed in the facing sides of said arms at an angle to said axis and said grooves engaging said slides;

5. The engine as defined in claim 1 wherein said articulation between said ball and said pistons comprises:

connecting rods extending from said pistons to said equator of said ball and attached thereto by ball joints; and counterweights diametrically opposite to each of said ball joints.

6. The engine in claim 1 wherein said support comprises:

an enclosure surrounding said ball;

bearing surfaces formed in said enclosure and contacting said ball above and below said equator;

a spring in said housing parallel to said axis and bearing against said support in the direction of said pistons; and a guide formed in said housing parallel to said axis and engaging said support for preventing rotation thereof while allowing axial movement thereof.

7. The engine as defined in claim 6 wherein said spring is replaced by a piston under manual control.

8. The engine as defined in claim 4 wherein:

said extending portion of said drive shaft is provided with a diametrically throughgoing bore which slidably receives a bar provided with counterweights at its ends, said bar being perpendicular to said drive shaft and acting as a flywheel.

* * * * *